United States Patent [19]

Maasberg et al.

[11] Patent Number: 4,573,886

[45] Date of Patent: Mar. 4, 1986

[54] VALVE ASSEMBLY FOR HIGH PRESSURE PUMP

[75] Inventors: Wolfgang Maasberg, Hünxe-Krudenburg; Adalbert Huperz, Hockenheim, both of Fed. Rep. of Germany

[73] Assignee: Woma-Apparatebau Wolfgang Massberg & Co. GmbH, Duisburg, Fed. Rep. of Germany

[21] Appl. No.: 481,441

[22] Filed: Apr. 5, 1983

Related U.S. Application Data

[63] Continuation of Ser. No. 193,669, Oct. 3, 1980, abandoned.

[30] Foreign Application Priority Data

Oct. 6, 1979 [DE] Fed. Rep. of Germany ..... 2940606

[51] Int. Cl.[4] ..... F04B 21/00

[52] U.S. Cl. ..... 417/454; 417/568

[58] Field of Search ..... 417/454, 568, 567, 569; 137/540, 543.17, 543.19; 92/169

[56] References Cited

U.S. PATENT DOCUMENTS

| | | | |
|---|---|---|---|
| 339,885 | 4/1886 | Hill | 92/169 |
| 3,119,410 | 1/1964 | Noecker | 417/568 X |
| 3,224,042 | 12/1965 | Meissner | 92/169 X |
| 3,323,467 | 6/1967 | Heintz | 417/454 X |
| 3,490,344 | 1/1970 | Archer et al. | 92/169 |
| 3,510,233 | 5/1970 | Strebel et al. | 417/568 X |

*Primary Examiner*—Edward K. Look

*Attorney, Agent, or Firm*—Karl F. Ross; Herbert Dubno

[57] ABSTRACT

A valve assembly for a high-pressure pump has a valve housing formed with a central bore centered on a main longitudinal axis and a transverse bore extending radially from the central bore in opposite directions along a transverse axis and subdivided by the central bore into an intake transverse-bore part and an exhaust transverse-bore part. Respective intake and exhaust sleeves are provided in the intake and exhaust bore parts and in turn are provided with respective intake and exhaust valves. A flow-splitting sleeve is provided in the central bore and has a pair of lateral branches opening respectively in the intake and exhaust bore parts into the intake and exhaust sleeves. All three of these sleeves are received in the respective bores with radial play relative to the respective axes and form with the respective bores annular chambers that communicate with one another. The exhaust sleeve is formed with a throughgoing passage opening into the respective chamber so that all of the chambers are pressurized by the pump through this passage. Seals are provided to isolate the chambers from communication with the bores and the interiors of the sleeves except through this passage. In this manner the sleeves are externally hydrostatically braced in the housing.

12 Claims, 2 Drawing Figures

VALVE ASSEMBLY FOR HIGH PRESSURE PUMP

This application is a continuation of application Ser. No. 193,669, filed Oct. 3, 1980, now abandoned.

FIELD OF THE INVENTION

The present invention relates to a valve assembly for a high-pressure pump. More particularly this invention concerns such an assembly which includes the intake and exhaust port well as the intake and exhaust valves for a high-pressure reciprocal-piston pump.

BACKGROUND OF THE INVENTION

A high-pressure pump, for example of the type described in our U.S. Pat. No. 4,218,961 to which reference should be made for further details, has a pump housing in which a piston is reciprocated. This piston normally projects from one end of the pump housing into a valve-assembly housing which has a main central bore aligned with the bore or cylinder of the pump housing and a transverse bore crossing this central bore and subdivided thereby into an intake-bore part and an exhaust-bore part. Respective intake and exhaust ports and intake and exhaust valves are provided in these bore parts so that with each reciprocation of the piston the pump fluid will be drawn in through the intake port and valve and then exhausted through the exhaust valve and port. Such a valve assembly can be seen in our copending application Ser. No. 948,542 (now U.S. Pat. No. 3,256,139).

The main problem with such arrangements is that the valve housing fails after a relatively short service life. This valve housing is subjected to very high operating pressure and frequently also to pressure peaks that are sufficiently large to crack the housing. The high-pressure fluid erodes the bores relatively rapidly and can, in fact, cause virtually explosive failure of the valve housing.

It is standard practice to make the valve housing of the most rugged possible materials, normally expensive and difficult-to-machine steel alloys.

OBJECTS OF THE INVENTION

It is therefore an object of this invention to provide an improved valve assembly for a high-pressure pump.

Another object is to provide such a valve assembly which will have a substantially longer service life than the prior-art valve assemblies.

Yet another object is to provide such a valve assembly which can easily be serviced and refitted if necessary.

SUMMARY OF THE INVENTION

These objects are attained according to the instant invention in a valve assembly having respective intake and exhaust sleeves in the intake and exhaust bore parts of the transverse bore and a flow-splitting sleeve in the central bore and having a pair of lateral branches opening respectively in the intake and exhaust bore parts into the intake and exhaust sleeves. These sleeves are all received in the respective bores with radial play relative to the respective axes and they form with the respective bores respective annular chambers that communicate with one another. One of the sleeves is formed with a radial passage opening into the respective chamber so that all of the chambers are pressurized by the pump through the passage, this passage normally being provided in the exhaust sleeve. Seals are provided and engaged between these sleeves and the respective bores for isolating these chambers from communication with the bores and with the interiors of the sleeves except through this passage.

Thus the system according to the instant invention will hydrostatically balance forces on these sleeves. The pressurized fluid surrounding the sleeves will not move appreciably, but with nonetheless act inwardly on these sleeves with a force substantially equal to the outwardly effective force on these sleeves. Thus it is possible for the system according to the instant invention to withstand substantial peak pressures without damage. The system is accordingly very useful in systems where the main function of the pump is to create a very high hydrostatic pressure, not mainly for dynamic flow through the pump.

Since there is no appreciable flow around the sleeves, between the sleeves and the valve housing, there will be virtually no erosion of the valve housing by the pumped fluid. The housing can therefore be made of a conventional steel which, although sufficiently strong to withstand substantial forces, would not normally be usable because of its erodability. The sleeves, on the other hand, are made of an appropriate alloy with a high tensile strength and resistance to erosion.

The pressurized fluid in the chambers surrounding the various sleeves also serves to damp vibrations. Thus dynamic peak loads are avoided as is noise generated by the valve assembly according to this invention. The sleeves furthermore can relatively easily be removed from the valve assembly and replaced so as to renew the only wear parts of the system. Normally parts of mirror finish are used to further eliminate the likelihood of erosion and cracking.

According to features of this invention the intake and exhaust sleeves are urged along the transverse axis toward each other by respective screws in the valve housing. Thus these sleeves are braced against the flow-splitting sleeve so that the three sleeves remain braced tightly against one another with their respective interiors communicating. To this end the flow-splitting sleeve is formed in the region of its branch passages with a groove in which the intake and exhaust sleeves engage. The combination of hydrostatic and mechanical bracing of these sleeves ensures a leak-free connection between the interior of the intake and exhaust sleeves and the respective branches of the flow-splitting sleeve.

According to another feature of this invention each of the intake and exhaust sleeves has a relatively small-diameter inner face turned toward the splitting sleeve, a large-diameter outer face engaging the respective screw, and a shoulder between the end faces and in the respective chamber. Thus pressure in the chamber of each intake and exhaust sleeve urges these sleeves axially outwardly into tight contact with the respective mechanical tightening screw. Such constant stressing of the screwthread connection prevents the screws from vibrating loose. Furthermore, such a static force continuously effective on the threads eliminates the possibility of long-term breakdown which is more likely to occur as the difference between static prestressing of the sleeve and peak loading increases.

SPECIFIC DESCRIPTION

Figure 1:
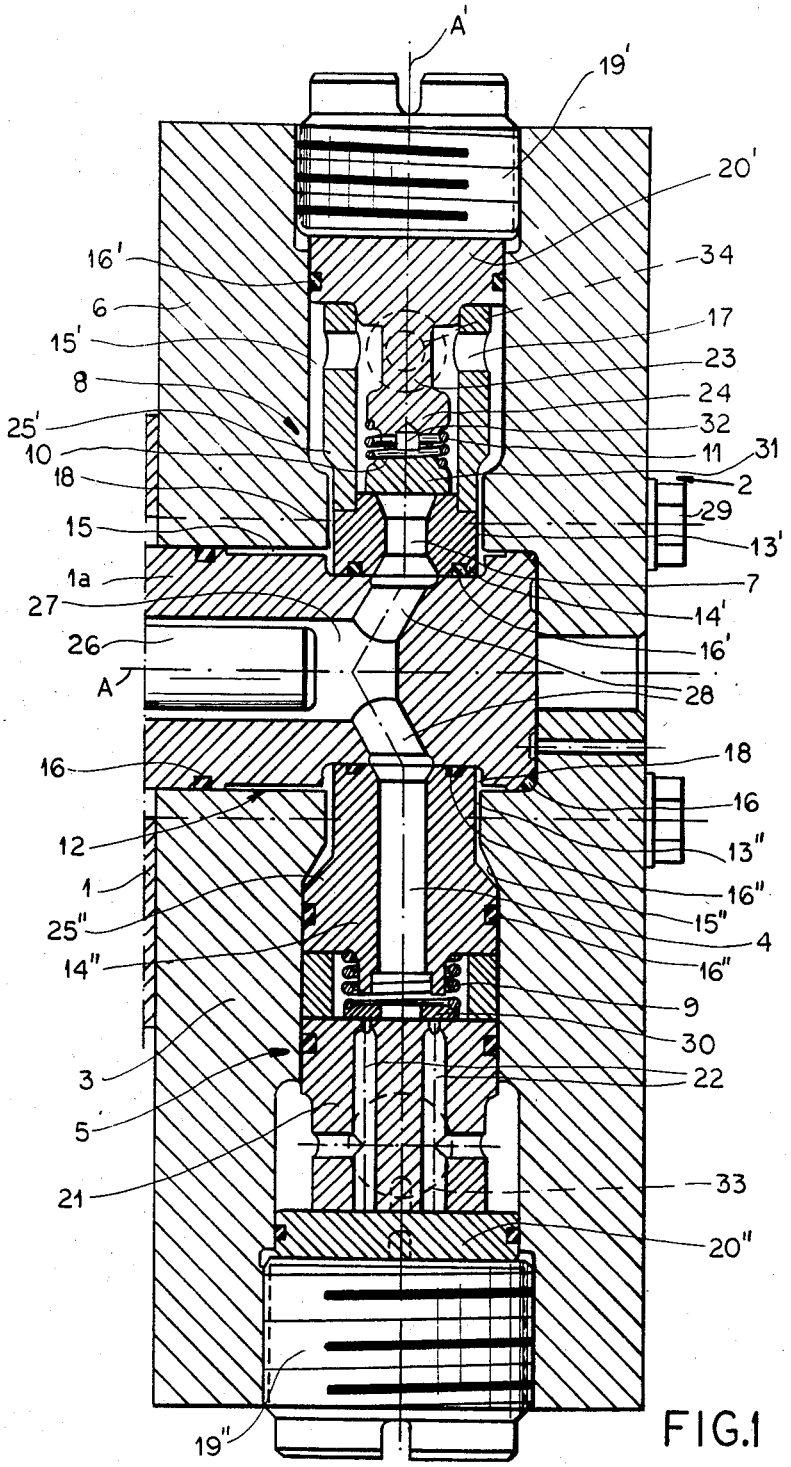
FIG. 1 is an axial section through a valve assembly according to this invention.

A valve assembly according to this invention is adapted to be mounted on a pump housing 1 of a pump of the type described in our above-cited U.S. Pat. No. 4,218,961. Such a pump has a piston 26 reciprocal along a main axis A and capable of projecting beyond the end of its pump housing 1.

Secured to this pump housing 1 by bolts 29 is a valve-assembly housing 2 having a suction or intake side 3 formed with a respective intake passage 4 provided with an intake valve 5, and a pressure or exhaust side 6 formed with a respective pressure or exhaust passage 7 housing a pressure or exhaust valve 8. The two passages or bores 4 and 7 are centered on an axis A' perpendicular to the axis A. In addition the valve housing 2 is formed with a central bore 12 that aligns with the bore of the housing 1 and that is centered on the axis A.

The intake valve 5 comprises a valve washer 30 carried on a spring 9 in a manner substantially identical to that for the valve shown at 5 in our above-cited copending application. More particularly the valve body 30 of the intake valve shown here in FIG. 1 at 5 is constituted of a thin washer of basically rectangular section. It can overlie a seat formed at an insert having an angular array of stepped bores 22 whose inner ends constitute the annular intake portions that can be blocked by this washer member 30.

Similarly the valve 8 has a valve body 31 formed as a flat disk having a shoulder over which is fitted one end of a spring 11 whose other end is received against a shoulder of a part 24 described in more detail below and having pressure-relieving passages 32 as described in our above-cited copending application so that as the valve body 31 moves backwardly pressure between its back surface 10 and the part 24 will be relieved gently. Reference should be made to this copending application 948,542 for more details about the operation of the valves shown here at 5 and 8.

According to the instant invention fitted into the end of the housing 1 and into the bore 12 is a generally cylindrical sleeve 1*a* having a central passage 27 centered on the axis A for receiving the piston 26 and a pair of opposite branch passages 28 extending at angles of approximately 120° to the axis A and terminating at their outer ends at ellipses centered on the axis A'. This sleeve 1*a* is formed with a circumferential groove 18 at the mouths of the branches 28 and fits loosely within the bore 12 so that an annular chamber 15 is created around it.

Received loosely within the exhaust and intake bores 13' and 13" are respective sleeves 14' and 14" forming respective annular chambers 15' and 15" with the interiors of the respective bores 13' and 13". These chambers 15' and 15" communicate with the chamber 15 and therethrough with each other. Seals 16, 16' and 16" respectively prevent liquid flow between the chambers 15, 15', and 15" and anything but each other and the interior of the sleeve 14' which to this end is formed with a plurality of radially throughgoing bores or passages 17.

Each of the sleeves 14' and 14" is formed by three separate parts, an inner part, and outer part, and an intermediate part. More particularly the sleeve 14' is constituted by an inner part which forms the seat for the exhaust valve body 31, by an intermediate part forming a shoulder 25' and having the passages 17, and by an outer part 20' constituted as a washer with a central tubular extension 23 of narrow diameter terminating at a relatively large head constituting the part 24. A screw 19' threaded into the outer end of the bore 13' is braced against the outer face of the sleeve 14' and urges it inward against the sleeve 1*a*.

The sleeve 14" has an outer part 21 formed with intake bores 22 and engaged by a separate washer 20" against which a screw 19" substantially identical to the screw 19' bears axially, relative to the axis A'. The inner part of this sleeve 14" forms an inwardly directed shoulder 25".

The housing 2 is made of heavy-duty steel, but the sleeves 1*a*, 14', and 14" are made of a much stronger but normally much more brittle material which has the advantage of being substantially less erodable.

Figure 2:
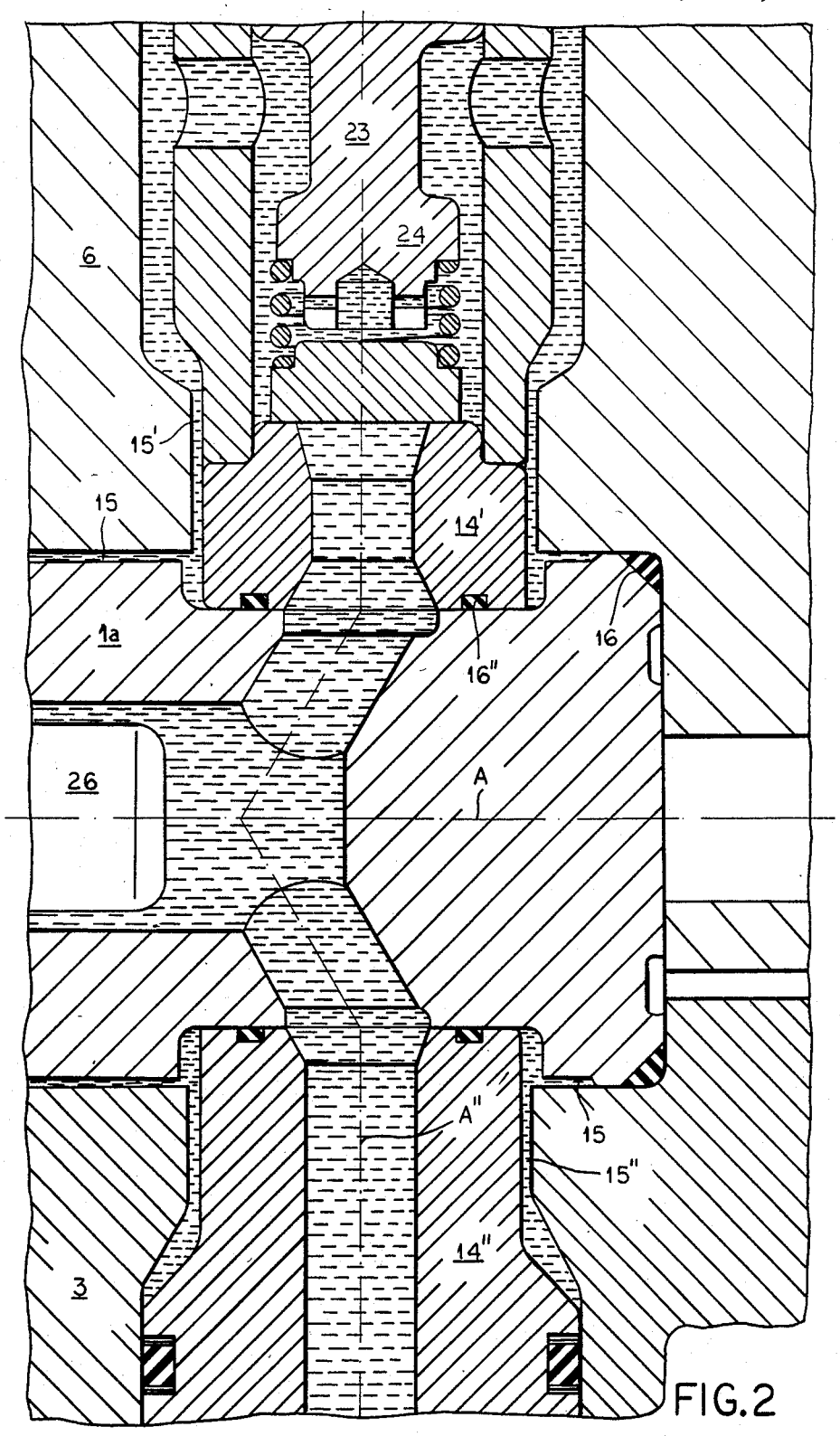
FIG. 2 is a large-scale view of a detail of FIG. 1.

In use an intake port 33 opening into the bore part 13" outside the valve 5 is connected to a supply of fluid and an exhaust port 34 opening into the chamber 15' is connected to a system to be pressurized, normally hydrostatically. As the piston 26 is reciprocated, therefore, pressure will build up in the passages 27 and 28 as well as in the passages 4 and 7. As the valve 8 opens, however, the chamber 15' will become pressurized at the same pressure as the system, and the same pressure will be effective in the other chambers 15 and 15" which all communicate with each other as is clearly visible in FIG. 2. This pressure will therefore be effective radially inward on the sleeves 14' and 14" relative to the respective axis A', and inward on the sleeve 1*a* relative to the respective axis A. As a result there will be a hydrostatic counterbalancing of the pressure on these sleeves 14' and 14" so that they can be expected to have an extremely long service life. At the same time they are easily capable of withstanding enormous pressures in this manner, even though the materials they are made of would normally not allow them to be used in this type of application. The relatively massive housing 2 which, if it were directly exposed to fluid flow, would erode rapidly, can withstand the pressure of this system easily. Thus an extremely long service life will surely be obtained.

In addition the system according to the instant invention is relatively easy to service. The two sleeves 14' and 14" can relatively easily be removed from the respective bores 13' and 13" by removal of the respective screws 19' and 19" so that servicing or replacement of the valves 5 and 8 is very easy.

We claim:

1. A valve assembly for a high-pressure pump, said assembly comprising:

a valve housing having a central bore centered on a main longitudinal axis and a transverse bore extending radially from said central bore in opposite directions along a transverse axis and subdivided by said central bore into an intake transverse-bore part and an exhaust transverse-bore part, the housing being of a material with a relatively low resistance to erosion;

respective intake and exhaust sleeves in said intake and exhaust bore parts;

respective intake and exhaust valves in said intake and exhaust sleeves;

a flow-splitting sleeve in said central bore and having a pair of lateral branches opening respectively in said intake and exhaust bore parts into said intake and exhaust sleeves, said sleeves being received in the respective bores with radial play relative to the respective axes and forming with the respective bores respective annular chambers that communicate with one another, one of said intake and exhaust sleeves being formed with a radial passage opening into the respective chamber, the sleeves all being of a material with a relatively high tensile strength and resistance to erosion; and seal means including seals engaged between said sleeves and the respective bores for isolating said chambers from communication with said bores and the interiors of said sleeves except through said passage and for pressurization of said chambers by said pump through said passage, whereby there is substantially no flow in the annular chambers.

2. The assembly defined in claim 1 wherein said one sleeve formed with said passage is said exhaust sleeve.

3. The assembly defined in claim 1 wherein said splitting sleeve is formed with an outwardly open circumferential groove, said intake and exhaust sleeves engaging radially inwardly relative to said main axis against said splitting sleeve at said groove.

4. The assembly defined in claim 1, further comprising means for biasing said intake and exhaust sleeves radially inwardly relative to said main axis against said splitting sleeve.

5. The assembly defined in claim 4 wherein said means for biasing includes respective intake and exhaust screws threaded respectively into said intake and exhaust bore parts.

6. The assembly defined in claim 5, further comprising respective intake and exhaust disks sealing fitting in said intake and exhaust bore parts between the respective screws and sleeves.

7. The assembly defined in claim 1 wherein at least one of said intake and exhaust sleeves is subdivided transversely relative to said transverse axis into a plurality of axially succeeding sections bearing axially on one another.

8. The assembly defined in claim 1 wherein said exhaust sleeve has a large-diameter outer end face in flat contact with said housing, a small-diameter inner face in direct flat contact with said splitting sleeve, and a shoulder between said end faces and in the respective chamber.

9. The assembly defined in claim 1 wherein said branches form acute angles with said central axis and are angled away from said pump.

10. The assembly defined in claim 1 wherein the sleeves are loosely received in the respective bores.

11. The assembly defined in claim 10 wherein the annular chambers extend generally the full axial length of the respective sleeves.

12. A valve assembly for a high-pressure pump, said assembly comprising:

a valve housing having a central bore centered on a main longitudinal axis and a transverse bore extending radially from said central bore in opposite directions along a transverse axis and subdivided by said central bore into an intake transverse-bore part and an exhaust transverse-bore part, the housing being of a material with a relatively low resistance to erosion;

respective intake and exhaust sleeves loosely received in said intake and exhaust bore parts;

respective intake and exhaust valves in said intake and exhaust sleeves;

a flow-splitting sleeve loosely received in said central bore and having a pair of lateral branches opening respectively in said intake and exhaust bore parts into said intake and exhaust sleeves, said sleeves being received in the respective bores with radial play relative to the respective axes and forming with the respective bores respective annular chambers that communicate with one another and that extend axially generally the full length of the respective sleeves, one of said intake and exhaust sleeves being formed with a radial passage opening into the respective chamber, the sleeves all being of a material with a relatively high tensile strength and resistance to erosion; and seal means including seals engaged between said sleeves and the respective bores for isolating said chambers from communication with said bores and the interiors of said sleeves except through said passage and for pressurization of said chambers by said pump through said passage, whereby there is substantially no flow in the annular chambers.

* * * * *